United States Patent [19]

Landwehr et al.

[11] Patent Number: 4,850,215

[45] Date of Patent: Jul. 25, 1989

[54] STROKE LIMITING MEANS FOR FRICTION CLUTCH PRESSURE PISTON IN A SCREW PRESS

[75] Inventors: Hubert Landwehr, Neuss; Dieter Blom, Titz-Spiel; Horst Endter, Langenfeld; Hermann-Josef Trimborn, Monheim, all of Fed. Rep. of Germany

[73] Assignee: SMS Hasenclever Maschinenfabrik GmbH, Dusseldorf, Fed. Rep. of Germany

[21] Appl. No.: 166,210

[22] Filed: Mar. 10, 1988

[30] Foreign Application Priority Data

Mar. 10, 1987 [DE] Fed. Rep. of Germany ..... 3707676
May 29, 1987 [DE] Fed. Rep. of Germany ..... 3718246

[51] Int. Cl.[4] ..... B21J 9/18

[52] U.S. Cl. ..... 72/454; 72/453.01; 72/31; 100/289

[58] Field of Search ..... 72/454, 453.01, 31; 100/289

[56] References Cited

U.S. PATENT DOCUMENTS

| | | | |
|---|---|---|---|
| 4,181,003 | 1/1980 | Kononov et al. | 72/454 |
| 4,563,889 | 1/1986 | Landwehr | 100/289 |
| 4,590,787 | 5/1986 | Trimborn | 72/454 |
| 4,606,217 | 8/1986 | Schiller et al. | 100/289 |

FOREIGN PATENT DOCUMENTS

| | | | |
|---|---|---|---|
| 3102665 | 1/1981 | Fed. Rep. of Germany | 72/454 |
| 3503917 | 3/1986 | Fed. Rep. of Germany | 72/454 |
| 3505935 | 8/1986 | Fed. Rep. of Germany | 72/454 |
| 1539333 | 1/1979 | United Kingdom | 72/454 |

*Primary Examiner*—David Jones

*Attorney, Agent, or Firm*—Fleit, Jacobson, Cohn, Price, Holman & Stern

[57] ABSTRACT

A screw press has a friction clutch for coupling the driving flywheel to the press spindle. The clutch is engaged by a hydraulic piston. To maintain a constant piston stroke as the friction clutch wears, a metering piston and cylinder are interposed between the clutch operating piston and the pressure fluid supply to trap pressure fluid in the clutch operating cylinder and to top it up as required, so that the operating piston stroke corresponds essentially to the fixed stroke of the metering piston. Fluid flow to the operating cylinder bypassing the metering piston is controlled by a normally closed valve arranged to be opened positively in dependence on the position of the metering piston, as the metering piston approaches the end of its stroke in the direction for pressurizing the clutch operating piston to engage the clutch. This arrangement ensures that the clutch cannot be inadvertently locked in an engaged condition.

10 Claims, 2 Drawing Sheets

STROKE LIMITING MEANS FOR FRICTION CLUTCH PRESSURE PISTON IN A SCREW PRESS

BACKGROUND OF THE INVENTION

This invention relates to screw presses.

A screw press conventionally comprises a press frame, a press slide movable in said frame, a press spindle coupled in screw threaded manner to the press slide for moving the latter on rotation of the spindle, drive means for rotating the spindle, a friction clutch between the drive means and spindle for rotationally coupling the drive means to the spindle on engagement of the clutch, clutch-operating pressure fluid actuated cylinder and piston means for engaging the clutch by application of pressure fluid to the cylinder and piston means; and a pressure fluid supply.

Commonly, the drive means comprise a flywheel, coaxial with the spindle.

In one commonly used construction, the friction clutch comprises an annular clutch disc or plate which can be moved axially by a clutch-operating piston, a clutch disc or plate connected to the spindle, and friction members, all disposed in an internal space enclosed by the flywheel and a clutch cover mounted on the flywheel. Return springs are provided, acting in the opposite direction to the clutch operating piston, to return the annular pressure disc to its initial position for releasing the clutch.

As the friction members become worn in operation, the operating piston has to execute an increasingly long stroke with a corresponding increase in the volume of pressure fluid required for operation to engage the clutch. This has the disadvantageous result that the operating characteristics of the press vary, as the friction members wear.

To overcome this disadvantage, screw presses have been provided with means to limit the stroke of the operating piston for disengaging the clutch and also for engaging the clutch.

Mechanical stroke-limiting means require constant monitoring of the friction member wear and corresponding manual adjustment of the stroke-limiting means.

German Pat. No. 3503917 describes an automatic hydraulically operating stroke-limiting means. In this, a metering unit comprises a metering piston which can move, with a limited stroke, in a metering cylinder. One end of the metering cylinder is connected to the pressure medium supply line, and the other end is connected to the cylinder of the clutch operating piston. A bridging line is provided in parallel with the metering cylinder and contains a non-return valve. To engage the clutch, pressure medium is applied to the metering cylinder, causing the metering piston to advance and expel, into the operating cylinder, pressure medium already present in the metering cylinder; the non-return valve remains closed while the metering piston advances, so that the clutch operating cylinder is not directly connected to the pressure medium supply. When the metering piston has advanced to its end position, a further pressure increase causes the non-return valve to open, so that the operating piston is loaded with the full pressure of the pressure medium supply. To release the clutch, the pressure medium is released and the non-return valve closes. The clutch pressure disc is lifted away from the clutch friction members by springs, acting on the pressure disc through pull rods, and carries the clutch operating piston with it, the volume between the clutch operating piston and the metering piston remaining full of pressure medium. The stroke of the operating piston is limited, by the restriction of the stroke of the metering piston in the metering cylinder. It will be understood, that the non-return valve operates to top up the volume of fluid in the clutch operating cylinder, as the clutch stroke increases with wear.

This apparatus however has the disadvantage that, if some form of failure prevents the metering piston from advancing, pressure will build up behind it and cause the non-return valve to open, thereby applying full fluid pressure to the clutch operating piston even though the metering piston has not reached its advanced end position. If then the pressure medium is released, the non-return valve will close, trapping pressure medium between the metering piston and clutch operating piston. Because the metering piston cannot move, or if it can move in its reverse direction, can move only by a reduced amount, the pressure medium cannot be fully discharged from the clutch operating cylinder into the metering cylinder, the friction clutch is not released or not fully released, and the screw press can be more or less severely damaged.

An object of the present invention is to provide stroke-limiting means for the clutch of a screw press, such as to provide automatic compensation for wear of the friction clutch, while ensuring proper release of the clutch even if the stroke-limiting apparatus fails.

SUMMARY OF THE INVENTION

According to the present invention, there is provided, in a screw press comprising a press frame, a press slide movable in said frame, a press spindle coupled in screw threaded manner to the press slide for moving the latter on rotation of the spindle, drive means for rotating the spindle, a friction clutch between the drive means and spindle for rotationally coupling the drive means to the spindle on engagement of the clutch, clutch-operating pressure fluid actuated cylinder and piston means for engaging the clutch by application of pressure fluid to the cylinder and piston means; and a pressure fluid supply:—means for limiting the clutch-releasing stroke of the said cylinder and piston means, comprising: a metering piston and cylinder unit connected in series between said pressure fluid supply and the said clutch-operating cylinder and piston means, comprising a metering cylinder defining a pressure fluid chamber that communicates with said cylinder and piston means, and a metering piston slidable in said metering cylinder between predetermined end positions and disposed between said pressure fluid chamber and said pressure fluid supply; a fluid flow passage that bypasses said metering piston for providing fluid communication between said pressure fluid supply and said pressure fluid chamber; a normally closed valve in said passage, and positive valve-operating means responsive to the metering piston position arranged and adapted to open the said valve in response to motion of said metering piston to a predetermined position in the direction towards said pressure fluid chamber;

whereby on application of pressure fluid from said supply to said metering unit said metering piston initially moves towards said fluid pressure chamber with said valve closed thereby expelling pressure fluid already in said chamber into said clutch-operating cylinder and piston means and thereafter said valve is opened by said valve-opening means in response to said motion of said metering piston for providing communication from said supply through said passage to said chamber and said cylinder and piston means, thereby engaging said clutch; and said valve automatically closes on motion of said metering piston away from said chamber.

In a preferred embodiment the said fluid flow passage extends through said metering piston and said valve is resiliently biased to its normally closed position; and said valve-operating means are arranged and adapted to open the said valve on motion of said metering piston to a predetermined intermediate position in the direction towards said pressure fluid chamber, said metering piston being arranged and adapted to move beyond said predetermined intermediate position towards said chamber after opening of said valve;

whereby said valve is automatically closed by the resilient bias thereof on motion of said metering piston away from said chamber.

In a particularly preferred embodiment, said metering piston has a first end face adjacent said pressure fluid chamber and an opposite second end face adjacent said pressure fluid supply, and a valve seat in said second end face in communication with said passage; and said valve comprises a valve member adjacent said valve seat, a valve stem extending from said valve member through said metering piston to said first end face, and means resiliently biasing said valve member into contact with said valve seat acting towards said chamber; and said valve-operating means comprise stop means in said chamber arranged to engage and stop said valve stem and thereby lift said valve member from said valve seat in the course of motion of said metering piston towards said chamber.

Preferably, there are further provided stop means arranged and adapted to limit motion of said metering piston away from said pressure fluid chamber and to positively hold said valve closed.

The invention also provides a stroke-limiting apparatus for the operating piston of a friction clutch which connects the spindle and flywheel of a screw press and which comprises an annular disc moved axially by the piston and a clutch disc connected to the press spindle and friction members in an interior space bounded by the flywheel and a clutch cover mounted thereon, and in which the annular disc can be returned by springs into its initial position in the direction opposite the action of the piston, and in order to limit the stroke of the said piston for venting purposes a metering piston movable in the pressure medium supply line to the pressure cylinder with limited stroke is provided and a bridging line for discontinuing the locking function of the metering piston to a limited extent in the direction of the pressure medium supply and provided with a topping-up valve is provided in the region of the metering piston, characterized in that the bridging line passes axially through the metering piston from one piston end face to the other and is provided with a valve seating for a valve cone which is disposed in the metering piston and is biased by spring pressure and which together with the metering piston forms a valve body, and a stop for limiting the engaging stroke is arranged in the path of the valve cone or the valve stem, while the metering piston has an ample freedom of further movement for opening the bridging line.

In the device of the invention, if the metering piston becomes jammed in its advancing motion, before the valve has opened, the valve will remain closed and the full supply pressure will not be applied to the clutch operating piston; subsequently, when the operating pressure is released, if the metering piston cannot retract, the pressure of the fluid medium trapped in the operating cylinder and metering cylinder can be arranged to open the valve and thereby release the clutch. Similarly, if the metering piston sticks in its normal advanced position, in which the valve has opened and then re-closed, the clutch can still be released because, when the supply pressure is released, the pressure of the fluid trapped in the operating cylinder and metering cylinder can open the valve to release the fluid. Should the metering piston stick in its fully advanced position with the valve already open, the clutch will be released expelling fluid through the valve, as soon as the operating medium supply pressure is released. Thus, it is not possible for the stroke-limiting device to cause the clutch to become jammed in an engaged, or insufficiently disengaged, condition.

In a preferred construction, which is space-saving and structurally advantageous, the clutch operating piston is cup-shaped, and the metering cylinder projects into the cup-shaped clutch operating piston and is connected to a cover which closes the end of the clutch operating cylinder. The metering cylinder may be constructed as a guide shaft for the clutch operating piston, so that the guidance and sealing of the latter are completely separate from each other.

The functioning of the apparatus, improved by the above mentioned separate guidance of the clutch operating piston, can be further improved if the operating piston and the annular pressure disc are separate from each other, and are connected to each other only in a non-rigid manner, by being constrained to move together by the clutch disengaging return springs which act on the pressure disc, so that the guidance of the operating piston is not affected by heating of the pressure disc which inevitably arises in operation. Preferably, the annular pressure disc is centred by the operating piston, with a sliding seating, such as to permit differing responses of the piston and pressure disc to heating in operation.

DESCRIPTION OF PREFERRED EMBODIMENTS

Figure 1:
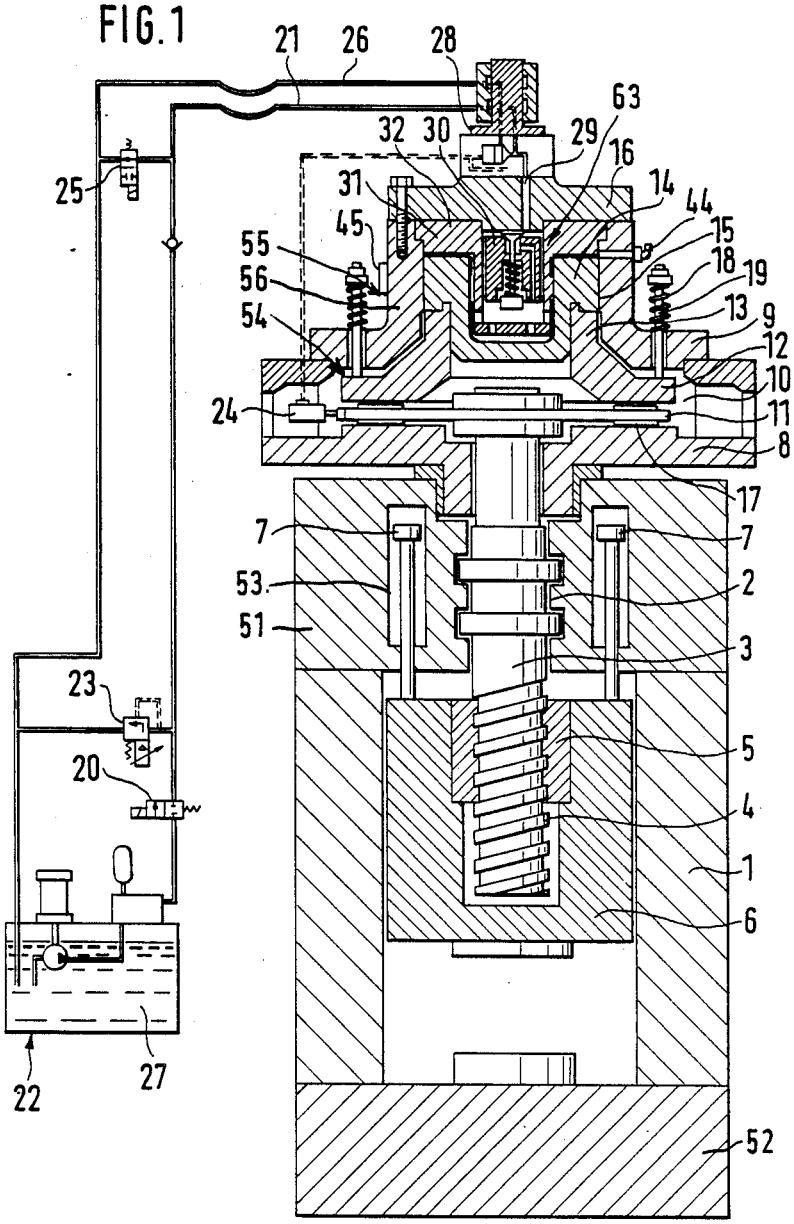
FIG. 1 shows, in axial section, an embodiment of the screw press according to the invention.

The illustrated screw spindle press has a frame 1, with an upper crosshead 51 in which is a thrust bearing 2, which rotatably receives a press spindle 3. At the lower end, the spindle has a screw threaded shank 4, engaged in a nut 5 which is attached to or forms part of a press slide 6 for carrying an upper press tool (not shown), facing a lower press tool (not shown) disposed on the lower crosshead or bed 52 of the frame. The press slide 6 is restrained against rotation, and therefore, is caused to descend when the press spindle 3 rotates anti-clockwise (as seen from above). Retraction pistons 7 moving in hydraulic cylinders 53 provided on the upper crosshead raise the slide 6 to its initial position.

For rotating the press spindle to drive the press slide downwards, a flywheel 8 is rotatably mounted in the upper crosshead, coaxially with the spindle. Any suitable form of drive means (not shown) is provided for rotating the flywheel. A friction clutch 54 is provided, for selectively coupling the rotating flywheel to the upper end of the press spindle. This friction clutch comprises a clutch disc 11 while is rotationally fast with the upper end of the press spindle 3, an annular pressure disc 12 coaxial with and adjacent the clutch disc, and friction members 17. The friction clutch is disposed in a clutch chamber 10 within the flywheel and closed by an upper cover 9. The pressure disc 12 is provided with retraction or lift rods 19 on which are compression springs acting against the outer surface of the cover 9, resiliently biasing the pressure disc 12 upwards and away from the clutch disc 11 so that the friction clutch is normally in a disengaged condition.

For engaging the clutch to rotate the press spindle and lower the press slide, a clutch-operating pressure-fluid actuated cylinder and piston unit 55 is provided on the flywheel. The cylinder bore 15 of this piston and cylinder unit is defined within an upward extension 56 of the cover 9 and is closed off at its upper end by a cylinder cover 16 secured to the said extension. The pressure disc 12 has a corresponding coaxial extension or neck 13, having a central bore 57 and an upper end face 58 which both provide a connection to a clutch-operating piston 14 slidable in the cylinder bore 15. The operating piston 14 is cup-shaped, having an internal space 34, with an upper annular flange 59 seated on the neck 13 of the pressure disc 12, and provided with circumferential sliding seals 60 engaging the cylinder bore 15. The piston has a downwardly projecting cup-shaped body 61 which projects into the central bore or aperture 57 of the neck 13.

To engage the friction clutch for rotating the press spindle, hydraulic pressure fluid is admitted into the cylinder bore 15, that is into the cylinder space 62 above and within the piston 14, driving the latter downwards and therefore bringing the pressure disc 12 into engagement with the clutch disc 11 for effecting frictional engagement between the clutch disc and the flywheel 8. The rotation of the press spindle causes the press slide 6 to execute a descending working stroke. To release the friction clutch, and thereby enable the press slide 6 to be retracted to its initial position, fluid pressure in the clutch operating cylinder 62 is released, and the retraction springs 18 lift the pressure disc 12 and with it, the piston 14.

Hydraulic pressure medium for operating the friction clutch is supplied by a hydraulic unit 22 comprising an electric motor, pump, oil tank 27 and accumulator. Oil at a predetermined pressure can be supplied from the hydraulic unit 22 to the clutch operating cylinder by way of a normally closed valve 20 and an oil line 21. The valve 20 is opened to engage the clutch. A bypass or recirculation valve 25 is normally open to relieve the oil line 21 of pressure, and is closed when the valve 20 is opened to engage the clutch.

The clutch operating cylinder communicates with a bore 29 penetrating the cylinder cover 16, and thence, by way of a control valve 28 secured on the cylinder cover, with the oil pressure line 21 and with an oil drain line 26 connected to the tank 27.

To release the clutch, the bypass valve 25 is reopened to relieve the cylinder of pressure, and the control valve 28 connects the operating cylinder to the drain line 26.

At the end of the required working stroke of the press slide 6, the friction clutch must be released promptly and reliably to disconnect the press spindle from the flywheel, to prevent damage to the press, clutch or workpiece.

The end of the working stroke can be at a predetermined lower reversal point, set on a hodometer. Alternatively, the working stroke can be terminated when the press force has reached a value corresponding to a predetermined maximum oil pressure in the clutch operating cylinder, this maximum pressure being set at a governor valve 23. When the press force reaches a value corresponding to the maximum oil pressure, the resistance to further movement of the slide will overcome the friction in the clutch, and there will be slip between the spindle and clutch disc on the one hand, and the flywheel and pressure disc on the other hand. This slip is detected by a sensor 24 which controls the valve 28 to release the clutch.

As the friction members 17 wear, the position of the pressure disc 12 and piston 14 when the clutch is fully engaged, inevitably becomes lower, requiring a correspondingly larger volume of oil in the clutch operating cylinder 62. To compensate automatically for this effect, a stroke limiting device 63 is provided which limits the return movement of the piston 14 on release of the clutch to a substantially constant value, so that the amount of pressure fluid to be supplied in order to move the piston from its clutch-release position to its clutch-engaged position remains substantially constant. This is effected by automatically limiting the amount of pressure fluid discharged from the clutch operating cylinder when the clutch is released, and automatically topping up the volume of fluid in the cylinder each time the clutch is engaged, so that the volume of fluid which is retained in the clutch operating cylinder 62 in the time between working strokes of the press is automatically increased, and the piston 14 is correspondingly held at a progressively lower starting position, as the friction members 17 wear and lead to a correspondingly lower position of the piston 14 when the clutch is fully engaged.

Figure 2:
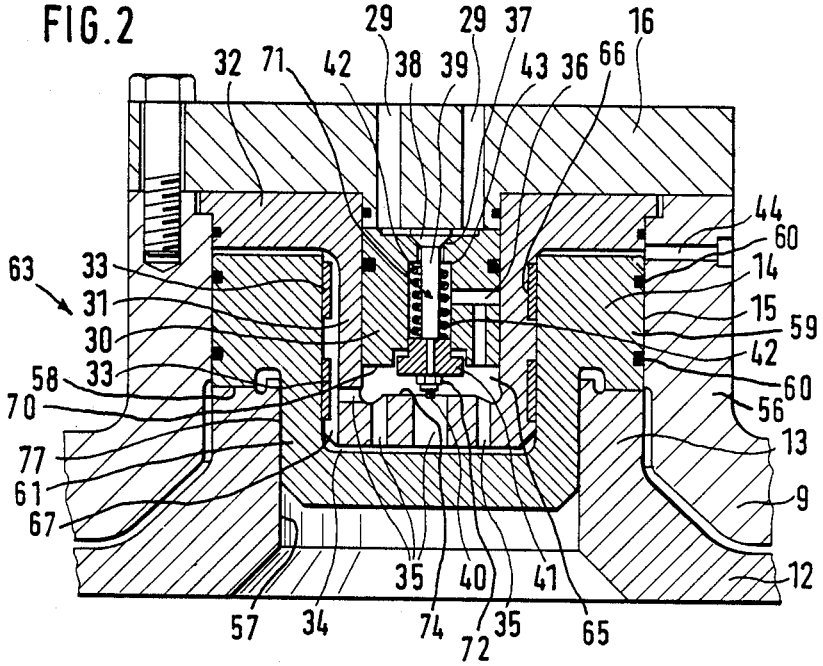
FIG. 2 is a cut away axial section of the clutch mechanism of the press, on a larger scale, in the clutch-disengaged condition.
Figure 3:
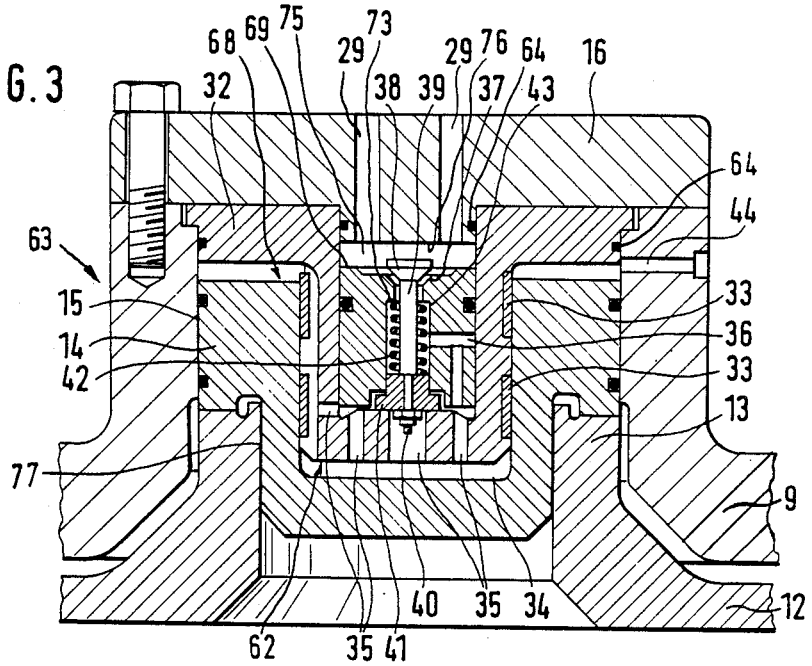
FIG. 3 is a view similar to FIG. 2, illustrating the condition in which the clutch is almost fully engaged, with the clutch operating cylinder being topped up with fluid.

The construction of the stroke limiting unit 63 is shown in detail in FIGS. 2 and 3. It essentially comprises a metering cylinder 31 and metering piston 30, disposed in the fluid flow path between the bore 29 and the clutch operating cylinder 62, for controlling the fluid flow into and out of the latter.

The metering cylinder 31 has, at its upper end, a flange 32 which is seated in the cylinder bore 15 within the upper end of the extension 56 of the clutch cover 9, and is clamped in place by the cylinder cover 16. The upper end 75 of the metering cylinder 31 is open, and communicates directly with the bore (or bores) 29 in the cover 16. Suitable peripheral seals 64 are provided between the metering cylinder 31, the cover 16, and the cover 9. The lower end region 65 of the metering cylinder 31 forms a pressure chamber which communicates with the interior space of the cup-shaped piston 14, through bores 35.

The metering cylinder 31 fits within and acts as a guide for the cup-shaped body 61 of the piston 14. It is provided with annular grooves 66 receiving guide segments 33 which guide the piston 14 on the internal surface of the piston. The external peripheral surface of the piston 14 adjacent the bore 15 is provided with peripheral seals 60 against the cylinder bore but does not serve to guide the piston 14. The piston 14, guided on the metering cylinder 31, in turn centres the pressure disc 12, the neck 13 of which embraces the piston 14 with a sliding seating 77 sufficient to compensate for differences in thermal expansion of the pressure disc 12 and piston 14, which inevitably arise in operation. The pressure disc 12 is not positively secured to the piston 14, but is held axially against it by the retraction springs 18, so that the pressure disc 12 and piston 14 are at all times held in contact and constrained to move together.

The metering piston is provided with flow means bypassing the guide segments 33, for example longitudinal slots 67, so that pressure fluid communication is provided between the upper outer region 68 and the lower inner region 34, defining the clutch operating cylinder 62.

The metering piston 30 is movable freely, but with a limited stroke, in the metering cylinder 31. A bridging flow passage 36 extends through the metering piston from the upperend face 69 of the piston to the lower end face 70. The upper end of the passage 36 emerges centrally in the upper end face 69 of the metering piston and forms a valve seating surface 37. The lower end of the passage 36 emerges in the lower end face 70 of the metering piston at a radially offset position. Flow through the passage 36 is controlled by a normally closed valve member 71 comprising a valve cone 38 cooperating with the seat surface 37, and a valve stem 39 extending from the valve cone 38 axially through the metering piston and projecting from the lower end face of the latter. The lower end of the valve stem is provided with a screw thread 40 onto which is screwed a nut 72 which retains a spring seat disc 41 projecting below the lower end face 70 of the metering piston. A valve-closing spring 42 is held under prestress between the disc 41, and a shoulder 78 at the upper end of a coaxial bore 43 extending through the metering piston from the seat surface 37. The upper region of the bore 43 forms part of the bridging passage 36.

The spring 42 normally holds the valve cone 38 seated on the surface 37, closing the passage 36, as shown in FIG. 2, in which the supply fluid pressure is relieved and accordingly the metering piston is at the top end of its stroke.

When pressure fluid is applied to the upper end of the metering cylinder and piston through the bores 29, the metering piston moves downwards in the metering cylinder, with the passage 36 closed by the valve cone 38. Hydraulic fluid already enclosed in the lower end volume 65 of the metering cylinder below the metering piston, is thereby displaced through the bores 35 into the clutch operating cylinder 62, causing the piston 14 to descent to engage the friction clutch and initiate a working stroke of the press. As the metering piston descends, but before it has reached its lowest end position, the downwardly projecting disc 41 engages the lower internal end surface 74 of the metering cylinder. Lost motion is provided between the disc 41 and valve member on the one hand, and the metering piston on the other hand, so that when the downward motion of the disc 41 is arrested by engagement with the lower end of the metering cylinder acting as a stop, the metering piston continues to descend under the action of the applied pressure, so that the valve seat 37 moves clear of the valve cone 38, compressing the spring 32, and the passage 36 is opened for fluid flow from the bores 29 to the clutch operating cylinder, thus applying the full supply pressure to the clutch operating piston 14 and ensuring that the volume of fluid in the clutch operating cylinder is sufficient to hold the piston 14 in its position ensuring full engagement of the clutch. The cylinder end surface 74 also forms a stop limiting the stroke of the metering piston 30. When the pressure in the clutch operating cylinder 62 has become equal to the full supply pressure, the valve spring 42 lifts the metering piston so that the seat 37 engages the valve cone 38, closing the passage 36 and thereby trapping hydraulic fluid in the clutch operating cylinder 62.

At the end of the press working stroke, the bores 29 and hence the upper end region 75 of the metering cylinder are relieved of pressure and connected to the oil tank, as described above. The springs 18 lift the pressure disc 12 to release the clutch, and thereby positively lift the piston 14, which displaces hydraulic fluid from the clutch operating cylinder 62 through the bores 35 into the lower end region 65 of the metering cylinder below the metering piston, thus displacing the metering piston upwards until it meets a stroke-limiting stop surface 76 of the cylinder cover 16. Preferably, it is the valve cone 38 that meets this stop surface, rather than the metering piston proper, so that in this condition not only is the metering piston stroke, and hence the clutch operating piston stroke, positively limited, but also the valve member is positively held closed.

It will be seen that the amount of hydraulic fluid discharged from the clutch operating cylinder when the clutch is released, always corresponds to the limited predetermined displacement of the metering piston in the metering cylinder, and is therefore constant. Therefore, the amount of hydraulic fluid which has to be supplied to engage the clutch, can differ, from one working stroke to the next, only by the amount that corresponds to the intervening amount of wear in the friction clutch. The amount of wear between one working stroke and the next is so small that the amount of hydraulic fluid required to engage the clutch is almost constant. The small amount of hydraulic fluid necessary to top up the volume of fluid retained within the clutch operating cylinder between strokes, is provided by the flow through the passage 36 when the metering piston is in its lowest position and the valve member is open.

If the metering piston becomes jammed when an attempt is made to engage the clutch, the valve cone 38 will remain closed so that pressure fluid cannot be applied to the piston 14 and therefore the clutch cannot be engaged, or cannot be engaged under full pressure. If the metering piston jams in its lowest position with its valve open, the clutch will be correctly disengaged as soon as the fluid pressure in the bores 29 is relieved, because the pressure fluid can be displaced from the clutch operating cylinder through the passage 36. If, when an attempt is made to release the clutch, the metering piston jams in an intermediate position with its valve closed, in particular, in the slightly raised normal position which the metering piston adopts after the clutch has been fully engaged, the clutch can still release because, with the pressure in bores 29 relieved, the pressure of the fluid trapped below the metering piston together with the pressure exerted by the action of the springs 18 lifting the disc 12 and piston 14, can force the valve cone 38 open and allow the fluid to be discharged from the clutch operating cylinder through the passage 36.

For proper operation of the apparatus, it is necessary to provide for complete venting, and accordingly a venting valve 44 is connected to the clutch operating cylinder.

Although it is not necessary to adjust the stroke limits in accordance with the amount of wear of the friction members 17, a display device 45 is nevertheless provided, connected to a pull rod 19 of the pressure disc 12.

The described press has a single central clutch operating piston. Alternatively, the clutch may be operated by an annular piston, or by a plurality of pistons and cylinders distributed around the periphery of the pressure disc; in this latter case, a plurality of metering piston and cylinder units may be provided, in particular, one for each clutch operating piston.

In the described embodiment, the valve in the metering piston is opened by engagement of the valve stem with a stop surface at the lower end of the metering cylinder. In an alternative construction, the valve is opened by a stop arranged in the path of the valve cone, as the metering piston approaches its advanced end position.

In yet another alternative arrangement, the bypass or bridging passage, and its controlling valve, are not provided in the metering piston, but in another location providing fluid communication from the supply to the clutch operating piston bypassing the metering piston, and operating means are provided which are actuated by the metering piston as it approaches its advanced end position, to open the valve.

We claim:

1. In a screw press comprising a press frame, a press slide movable in said frame, a press spindle coupled in screw threaded manner to the press slide for moving the latter on rotation of the spindle, drive means for rotating the spindle, a friction clutch between the drive means and spindle for rotationally coupling the drive means to the spindle on engagement of the clutch, clutch-operating pressure fluid actuated cylinder and piston means for engaging the clutch by application of pressure fluid to the cylinder and piston means;

and a pressure fluid supply:— means for limiting the clutch-releasing stroke of the said cylinder and piston means, comprising:

a metering piston and cylinder unit connected in series between said pressure fluid supply and the said clutch-operating cylinder and piston means, comprising a metering cylinder defining a pressure fluid chamber that communicates with said cylinder and piston means, and a metering piston slidable in said metering cylinder between predetermined end positions and disposed between said pressure fluid chamber and said pressure fluid supply; a fluid flow passage that bypasses said metering piston for providing fluid communication between said pressure fluid supply and said pressure fluid chamber; a normally closed valve in said passage, and positive valve-operating means responsive to the metering position arranged and adapted to open the said valve in response to motion of said metering piston to a predetermined position in the direction towards said pressure fluid chamber;

whereby on application of pressure fluid from said supply to said metering unit said metering piston initially moves towards said fluid pressure chamber with said valve closed thereby expelling pressure fluid already in said chamber into said clutch-operating cylinder and piston means and thereafter said valve is opened by said valve-opening means in response to said motion of said metering piston for providing communication from said supply through said passage to said chamber and said cylinder and piston means, thereby engaging said clutch; and said valve automatically closes on motion of said metering piston away from said chamber.

2. A screw press according to claim 1 in which said fluid flow passage extends through said metering piston and said valve in said passage is resiliently biased to a normally closed position; and said valve-operating means is arranged and adapted to open the said valve on motion of said metering piston to a predetermined intermediate position of said metering piston in the direction towards said pressure fluid chamber, said metering piston being arranged and adapted to move beyond said predetermined intermediate position towards said chamber after opening of said valve;

whereby said valve is automatically closed by the resilient bias thereof on motion of said metering piston away from said chamber.

3. A screw press according to claim 2 further including stop means arranged and adapted to limit motion of said metering piston away from said pressure fluid chamber and to positively hold said valve closed.

4. The screw press of said claim 2 wherein said metering piston has a first end face adjacent said pressure fluid chamber and an opposite second end face adjacent said pressure fluid supply, and a valve seat in said second end face in communication with said passage; and said valve comprises a valve member adjacent said valve seat, a valve stem extending from said valve member through said metering piston to said first end face, and means resiliently biasing said valve member into contact with said valve seat acting towards said chamber; and said valve-operating means comprise stop means in said chamber arranged to engage and stop said valve stem and thereby lift said valve member from said valve seat in the course of motion of said metering piston towards said chamber.

5. A stroke-limiting apparatus for the operating piston of a friction clutch which connects the spindle and flywheel of a screw press and which comprises an annular disc moved axially by the piston and a clutch disc connected to the press spindle and friction members in an interior space bounded by the flywheel and a clutch cover mounted thereon, and in which the annular disc can be returned by springs into its initial position in the direction opposite the action of the piston, and in order to limit the stroke of the said piston for venting purposes a metering piston movable in the pressure medium supply line to the pressure cylinder with limited stroke is provided and bridging line for discontinuing the locking function of the metering piston to a limited extent in the direction of the pressure medium supply and provided with a topping-up valve is provided in the region of the metering piston, characterized in that the bridging line passes axially through the metering piston from one piston end face to the other and is provided with a valve seating for a valve cone which is disposed in the metering piston and is biased by spring pressure and which together with the metering piston forms a valve body, and a stop for limiting the engaging stroke is arranged in the path of the valve cone or the valve stem, while the metering piston has an ample freedom of further movement for opening the bridging line.

6. A stroke-limiting apparatus according to claim 5, characterized in that in the clutch-disengagement end position the metering piston has opposite it a second stop which acts upon the valve cone and which sets the end position of the metering piston and holds the spring-biased valve cone in the closed position.

7. A stroke-limiting apparatus according to claim 5, characterized in that the cylinder receiving the metering piston is connected to the cover closing the cylinder for the clutch operating piston and projects into the clutch operating piston which is constructed in the form of a cup.

8. A stroke-limiting apparatus according to claim 7, characterized in that the cylinder of the metering piston is constructed as a guide shaft for the clutch operating piston.

9. A stroke-limiting apparatus according to claim 8, characterized in that the clutch operating piston and the annular disc are separate, but are connected non-positively by the return springs acting upon the annular pressure disc.

10. A stroke-limiting apparatus according to claim 9, characterized in that the annular disc is centred by the clutch operating piston with a sliding seating permitting the differing heating of the annular disc and said piston.

* * * * *